US010449687B2

(12) United States Patent
Liu et al.

(10) Patent No.: US 10,449,687 B2
(45) Date of Patent: Oct. 22, 2019

(54) LOW-COST, CONTAMINATION-FREE CUTTING TOOL AND OPERATION METHOD AND USE METHOD THEREOF

(71) Applicant: AMTK TECHNOLOGY DEVELOPMENT CO. LTD, Beijing (CN)

(72) Inventors: Dong Liu, Beijing (CN); Bo Mu, Beijing (CN)

(73) Assignee: AMTK TECHNOLOGY DEVELOPMENT CO. LTD, Beijing (CN)

( * ) Notice: Subject to any disclaimer, the term of this patent is extended or adjusted under 35 U.S.C. 154(b) by 0 days.

(21) Appl. No.: 15/500,701

(22) PCT Filed: Mar. 22, 2016

(86) PCT No.: PCT/CN2016/076941
§ 371 (c)(1),
(2) Date: Jan. 31, 2017

(87) PCT Pub. No.: WO2016/155534
PCT Pub. Date: Oct. 6, 2016

(65) Prior Publication Data

US 2017/0217043 A1 Aug. 3, 2017

(30) Foreign Application Priority Data

Apr. 2, 2015 (CN) ..... 2015 1 0152703

(51) Int. Cl.
*B26F 3/00* (2006.01)

(52) U.S. Cl.
CPC ..... *B26F 3/00* (2013.01)

(58) Field of Classification Search
CPC ..... B01L 2300/0672; B01L 2300/0681; B01L 3/0275; G01N 2001/288; Y10T 83/2122; A23G 9/26; A23L 3/36
See application file for complete search history.

(56) References Cited

U.S. PATENT DOCUMENTS 3,318,105 A * 5/1967 Burroughs ..... F25C 1/18 62/351
3,921,980 A * 11/1975 Artzer ..... A63F 9/0252 124/73

(Continued)

FOREIGN PATENT DOCUMENTS

CA 2482065 A1 3/2005
CN 101817165 A 9/2010

(Continued)

OTHER PUBLICATIONS

PCT International Search Report (English and Chinese) and Written Opinion of ISA (Chinese) dated Jun. 28, 2016 issued in corresponding PCT International Application No. PCT/CN2016/076941.
Notice of First Review Opinion dated Jan. 18, 2016 issued in corresponding Chinese Patent Application No. 201510152703.0.

*Primary Examiner* — Jonathan G Riley
(74) *Attorney, Agent, or Firm* — Troutman Sanders LLP

(57) ABSTRACT

A low-cost, contamination-free cutting tool, and an operation method and a use method thereof. The cutting tool comprises a molding container (1). The molding container (1) contains a to-be-refrigerated liquid (3) which can be refrigerated to form a solid cutter (4). The cutting tool may or may not comprise a base container (6). The base container (6) comprises a seal member (2) and the to-be-refrigerated liquid (3) in the base container. The to-be-refrigerated liquid in the base container is refrigerated to form a frozen base (7). The cutting tool of the present invention uses the cutter and the frozen base that are formed by using the low-cost to-be-refrigerated liquid; one-time use prevents the cross (Continued)

contamination, the cutter does not need to be washed; and the cutting tool has low use cost and good universality, and is convenient for popularization and application.

7 Claims, 10 Drawing Sheets

(56) References Cited

U.S. PATENT DOCUMENTS

| | | | | |
|---|---|---|---|---|
| 5,018,667 | A | 5/1991 | Lloyd | |
| 5,102,473 | A | 4/1992 | Grohmann | |
| 5,111,984 | A * | 5/1992 | Niedbala | B24C 1/003 225/1 |
| 5,599,223 | A | 2/1997 | Mains, Jr. | |
| 2005/0151050 | A1* | 7/2005 | Godfrey | F25C 1/24 249/127 |
| 2012/0103421 | A1* | 5/2012 | Grenz | B01L 3/0275 137/1 |
| 2016/0177242 | A1* | 6/2016 | McDaniels | A23G 9/26 426/515 |

FOREIGN PATENT DOCUMENTS

| | | | | |
|---|---|---|---|---|
| CN | 203062861 | U | 7/2013 | |
| CN | 104816348 | A | 8/2015 | |
| DE | 19926913 | A1 * | 1/2000 | B24C 1/003 |
| GB | 2042399 | A | 9/1980 | |

* cited by examiner

LOW-COST, CONTAMINATION-FREE CUTTING TOOL AND OPERATION METHOD AND USE METHOD THEREOF

CROSS-REFERENCE TO RELATED APPLICATIONS

This is a U.S. national phase application under 35 U.S.C. § 371 of International Patent Application No. PCT/CN2016/076941, filed Mar. 22, 2016, which claims benefit of priority to Chinese Patent Application No. 201510152703.0, filed Apr. 2, 2015. The entire contents of these applications are hereby incorporated by reference.

TECHNICAL FIELD

The present invention relates to a cutting tool and the operation method and use method thereof, and in particular relates to a low-cost, contamination-free cutting tool and the operation method thereof.

BACKGROUND ART

Most of the cutting machines of the prior art use a repeatedly used cutter to perform cutting operations on the cut materials. A trace of the materials to be cut will reside on the cutter after the cutter is used, and an elution cannot clear the residuals completely. Thus, the repeatedly used cutter will contaminate the next sample to be cut.

For example, the Chinese utility model patent (Patent No. 201320029373.2) discloses a dry blood filter paper puncher, which uses a repeatedly used punching patrix to perform punching operations on dry blood filter paper repeatedly. Here, the dry blood filter paper is the material to be cut. Although the material to be cut is dry, the material to be cut and the samples cut off will still get contaminated during cutting and punching operations and cannot be guaranteed to be clean and contamination free, resulting in sample contamination and test result errors.

SUMMARY OF THE INVENTION

To overcome the technical problem in the prior art, the present invention is intended to provide a low-cost, contamination-free cutting tool and the operation method and use method thereof. The cutter and frozen base used for the cutting tool are formed by freezing a low-cost liquid and they are disposable so that cross-contamination caused by repeated use of a cutter to the samples and the object to be cut can be prevented, no cross-contamination will happen to the object to be cut during cutting operations, and no washing is required for the cutter. The use cost is low and the accuracy of sample test and the cleanness of the samples and the material to be cut can be guaranteed to the greatest extent. The cutting tool can be used to perform cutting operations on various materials and has excellent universality. Using water as a liquid to be frozen, the cutting tool has the characteristics such as a low cost and no contamination, and can satisfy the requirements of various cutting operations. It is easy to popularize the cutting tool in the present invention.

To solve the above-mentioned problem, the following technical solution is adopted for the present invention;

A low-cost, contamination-free cutting tool comprises a molding container, the molding container contains a liquid which can be frozen into a solid cutter, and a seal member used to seal an opening of the molding container is set on the molding container;

a liquid to be frozen is poured into the molding container, the seal member keeps the liquid to be frozen contained in the molding container; after the molding container together with the seal member is put into a refrigerating chamber, the liquid to be frozen is quick frozen to form a solid cutter, then the seal member is removed, the cutter and the molding container are moved to the position of the object to be cut, a heating mechanism heats the exterior wall of the molding container so that slight melting happens to the contact surface between the cutter and the molding container, and an impact mechanism is used to quickly impact the cutter so that the cutter moves quickly to perform cutting operations on the object to be cut;

said cutting tool further comprises a base container, the base container comprises a seal member used to seal an opening of the base container and a liquid to be frozen in the base container, the liquid to be frozen in said base container is frozen into a frozen base, the object to be cut is attached to the frozen base, and the cutter performs cutting operations on the object to be cut on the frozen base so that the object to be cut will not contact other parts of the cutting tool.

The cutter cooperates with the frozen base to perform cutting operations. The cutter and the frozen base are both disposable, cutting operations can be guaranteed to be performed in a clean environment, no cross-contamination will be caused, and no washing is required for the cutting tool so that the convenience and efficiency of cutting operations are greatly improved. In addition, water serving as the liquid to be frozen guarantees a low use cost.

Preferably, the molding container is in the shape of a column, the cross-section of the molding container is an enclosed shape consisting of a plurality of straight lines and/or arcs connected end to end, the column can be a round cylinder, elliptical cylinder, cuboid, or prism, an opening is set at the top and bottom of the molding container respectively, a seal member is set at the bottom opening of the molding container, and the liquid to be frozen is poured from the top opening of the molding container into the molding container. The shape of the molding container can be selected according to the application situation.

The object to be cut is a blood sampling card, and said cutting tool serves as a puncher to perform punching and cutting operations on the blood sampling card.

Preferably, the base container is in the shape of a column, and the cross-section of the base container is an enclosed shape consisting of a plurality of straight lines and/or arcs connected end to end; the column can be a round cutting tool, a cylinder, a cuboid, a prism, or others, subject to the convenience of application of the equipment; a through-hole cooperating with the cutter is set in the middle of the base container, and the cutter enters the through-hole in the frozen base after the cutter cuts the object to be cut on the top of the frozen base. The shape of the base container can be selected according to the application situation.

Preferably, the base container and the molding container are made of a metal. Before the cutting tool is used, the containers need to be heated so that it is easier for the cutting tool to release from the mold.

Preferably, said cutting tool works in an environment where the humidity does not need to be controlled to prevent electrostatic adherence.

Preferably, the impact mechanism is high-speed impact equipment.

Preferably, the liquid to be frozen is water or other liquids that can be frozen into a solid. It is convenient and cheap to use water. Water can quick be frozen into ice to meet the requirements of cutting operations and the use cost is extremely low.

An operation method of a low-cost, contamination-free cutting tool comprises the following steps:

(1) add a seal member to the bottom openings of the molding container and the base container to seal the bottom openings, respectively;

(2) pour the liquid to be frozen from the top openings of the molding container and the base container respectively until the volumes of the liquid to be frozen are 6/10 to 14/15 of the volumes of the molding container and the base container, respectively; the volume of the liquid to be frozen must be smaller than the volumes of the containers lest the solid the liquid is frozen into will protrude from the molding container and the base container because of volume expansion;

(3) move the molding container and the base container into which the liquid to be frozen is poured into a refrigerating chamber to quickly freeze the liquid into a solid state to form a cutter and a frozen base;

(4) remove the seal member from the bottom openings of the molding container and the base container, respectively;

(5) move the base container and the frozen base in it to the cutting station and put the object to be cut on the top of the frozen base;

(6) move the molding container and the cutter in it to the cutting station and keep the cutter right above the object to be cut and the lower end of the cutter aligned with the through-hole in the frozen base;

(7) use a heating mechanism to heat the side wall of the molding container so that slight melting happens to the contact surface between the cutter and the molding container to help the impact mechanism to push out the cutter; and (8) use an impact mechanism to impact the cutter to push out the cutter quickly so that the cutter performs cutting operations on the object to be cut and the cutter and the material cut off together enter the through-hole in the frozen base to complete cutting operations.

Preferably, the cutter and the frozen base are both disposable and can be discarded after cutting is completed. Thus, convenience, cleanness, and no contamination can be guaranteed for cutting operations, without any necessity of washing the cutting tool.

Preferably, liquid nitrogen quick freezing is adopted in the freezing chamber. Liquid nitrogen can quickly freeze the liquid to be frozen into a solid and thus the freezing efficiency and the working efficiency of the cutting tool are improved.

Preferably, said cutting tool is used to perform cutting operations on a solid or colloidal object to be cut, and the solid or colloidal object to be cut includes paper, plastic, and a biological sample. The cutting tool can perform cutting operations on various materials and has excellent universality.

The present invention has the following advantageous effects:

For the low-cost, contamination-free cutting tool in the present invention, the cutter and frozen base used for the cutting tool are formed by freezing a low-cost liquid and they are disposable so that cross-contamination caused by repeated use of a cutter to the samples and the object to be cut can be prevented.

For the low-cost, contamination-free cutting tool in the present invention, no cross-contamination will happen to the object to be cut during cutting operations, no washing is required for the cutter, the use cost is low, and the accuracy of sample test and the cleanness of the samples and the material to be cut can be guaranteed to the greatest extent.

For the low-cost, contamination-free cutting tool in the present invention, the cutting tool can be used to perform cutting operations on various materials and has excellent universality.

For the low-cost, contamination-free cutting tool in the present invention, water can be used as a liquid to be frozen, the cutting tool has the characteristics such as a low cost and no contamination and can satisfy the requirements of various cutting operations, and it is easy to popularize the cutting tool.

For the low-cost, contamination-free cutting tool in the present invention, no wet environment preventing electrostatic adherence is required so that the harsh requirements for the application environment are reduced.

For the operation method of the low-cost, contamination-free cutting tool in the present invention, the operation process is simple, and the cutting tool can perform cutting operations quickly so that the cutting tool can be applied in many fields to conveniently perform operations.

DESCRIPTION OF REFERENCE NUMBERS IN THE DRAWINGS

1. Molding container; 2. Seal member; 3. Liquid to be frozen; 4. Cutter; 5. Melting interface; 6. Base container; 7. Frozen base; 8. Cutting tool shaped column

SPECIFIC EMBODIMENTS

The following embodiments further describe the present invention.

Embodiment 1

Figure 1:
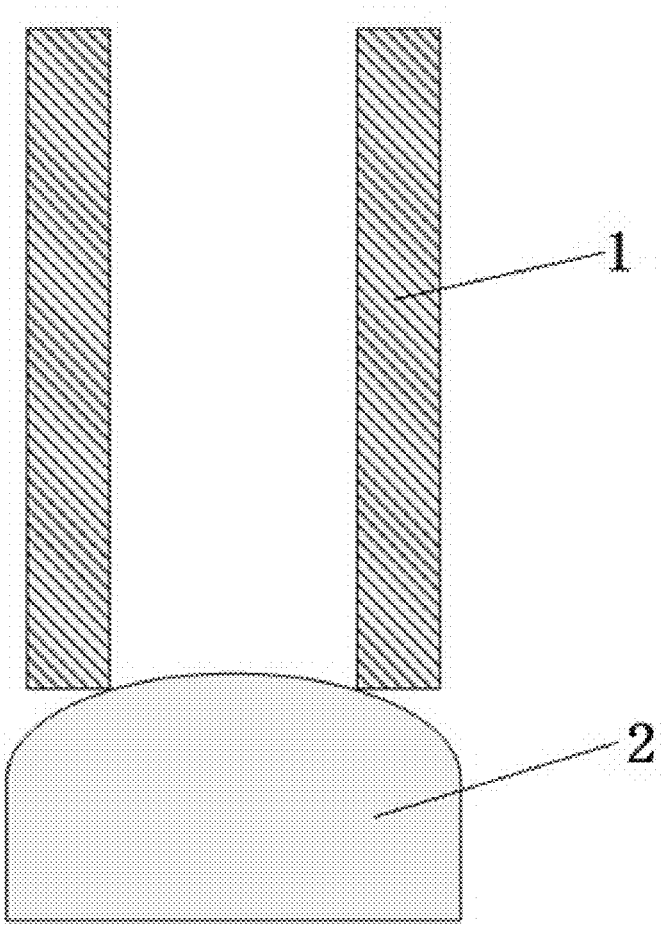
FIG. 1 shows Step 1 of the operation method of the low-cost, contamination-free cutting tool in the present invention.
Figure 2:
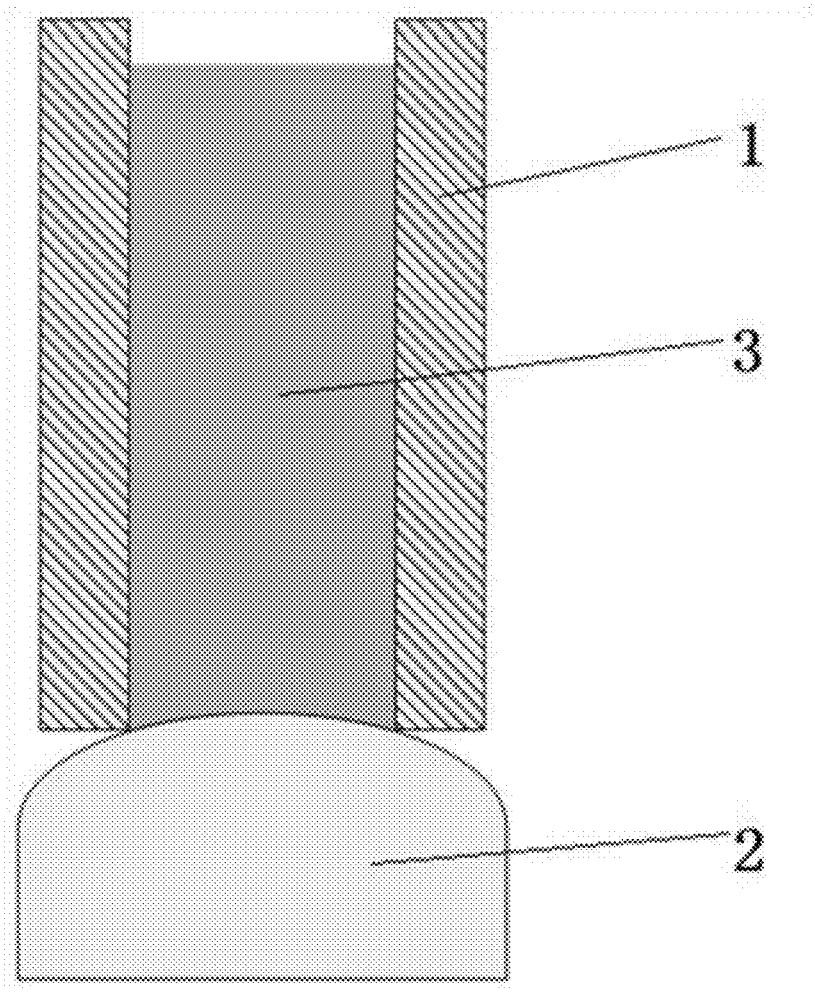
FIG. 2 shows Step 2 of the operation method of the low-cost, contamination-free cutting tool in the present invention.
Figure 3:
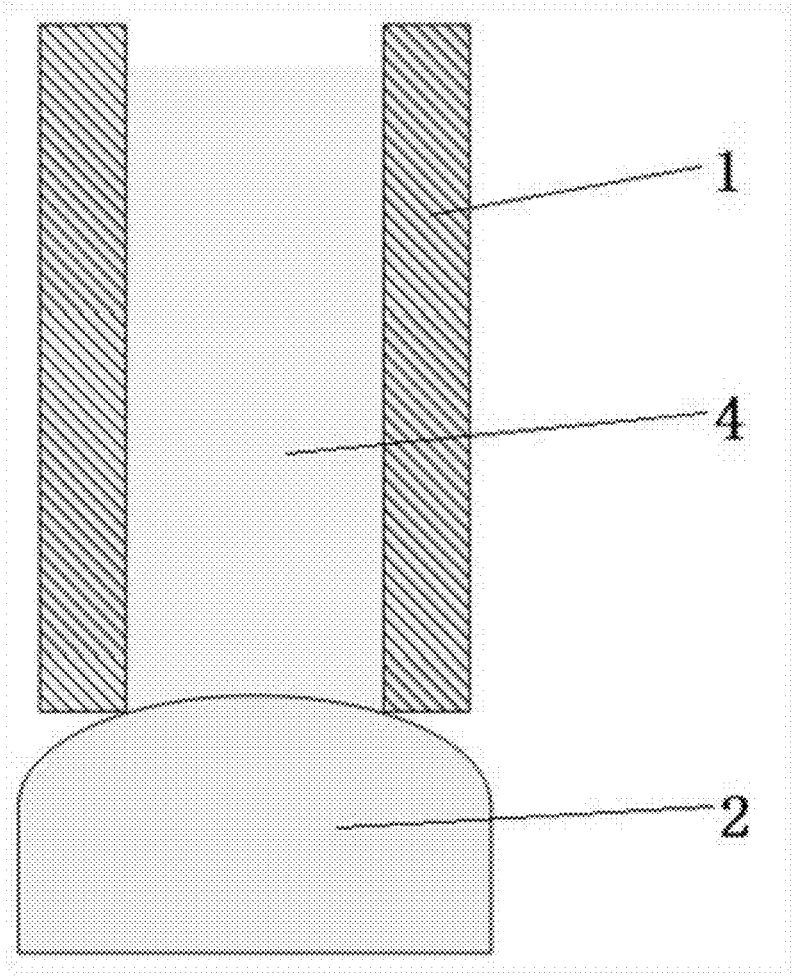
FIG. 3 shows Step 3 of the operation method of the low-cost, contamination-free cutting tool in the present invention.
Figure 4:
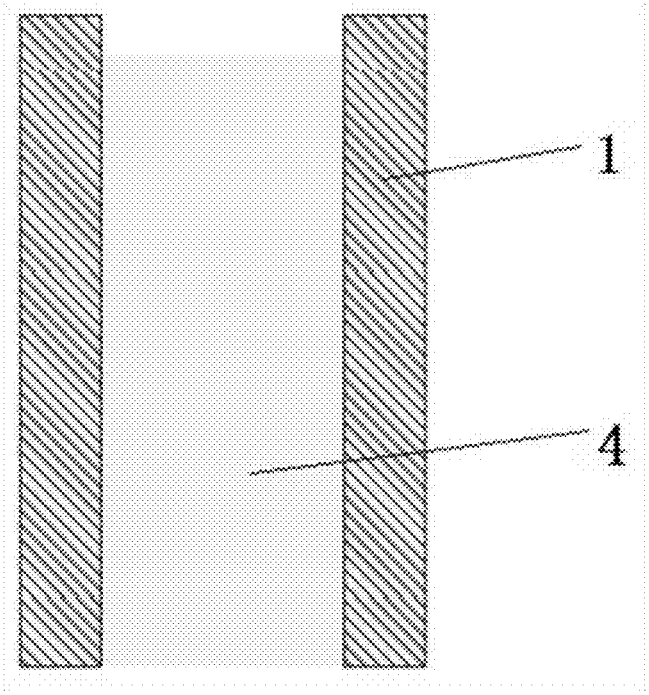
FIG. 4 shows Step 4 of the operation method of the low-cost, contamination-free cutting tool in the present invention.
Figure 5:
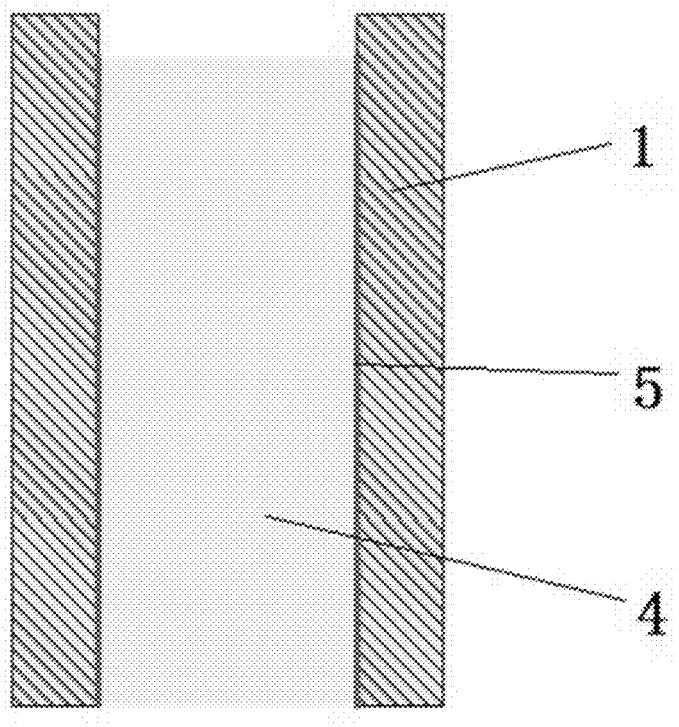
FIG. 5 shows Step 7 of the operation method of the low-cost, contamination-free cutting tool in the present invention.
Figure 6:
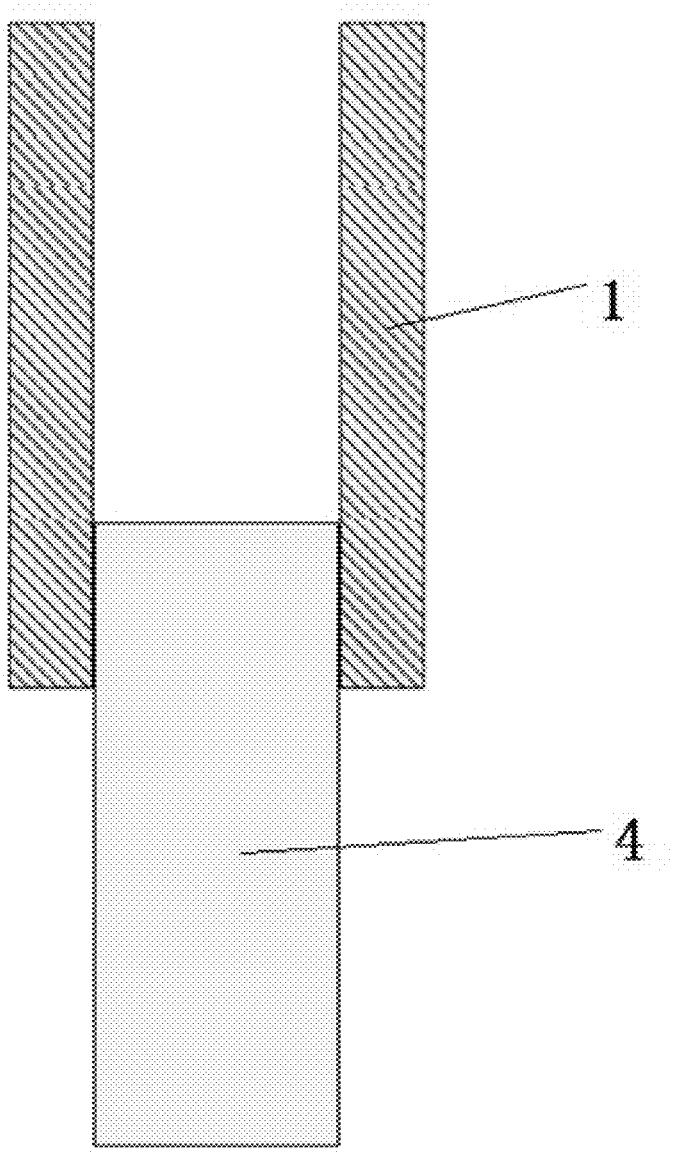
FIG. 6 shows Step 8 of the operation method of the low-cost, contamination-free cutting tool in the present invention.
Figure 7:
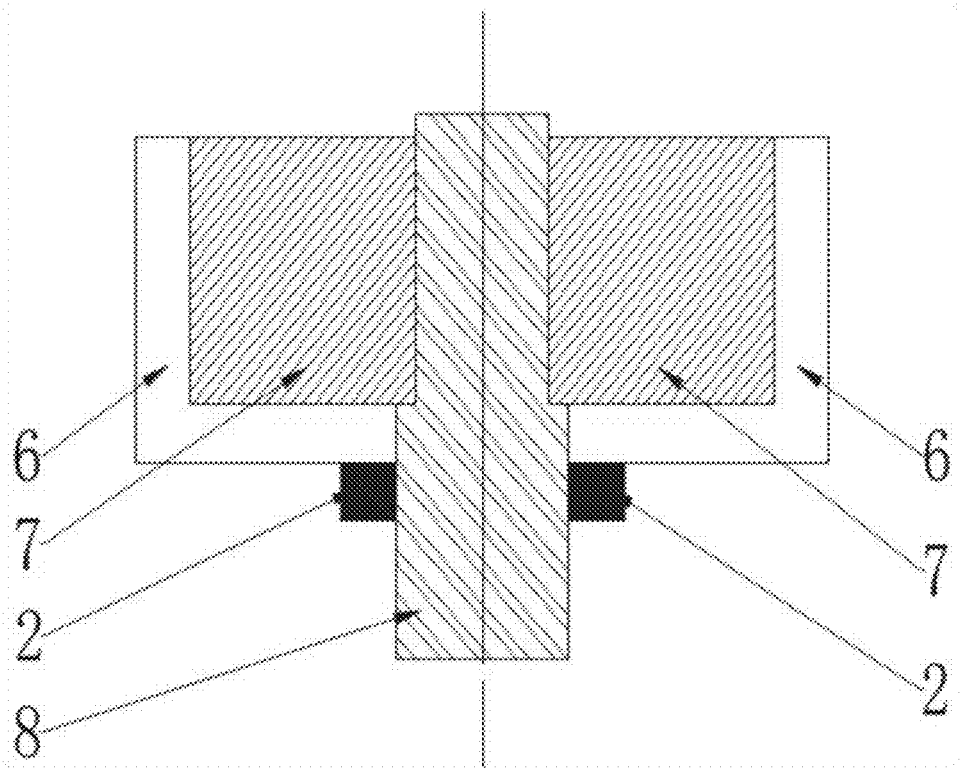
FIG. 7 shows the structures of the base container and the frozen base.
Figure 8:
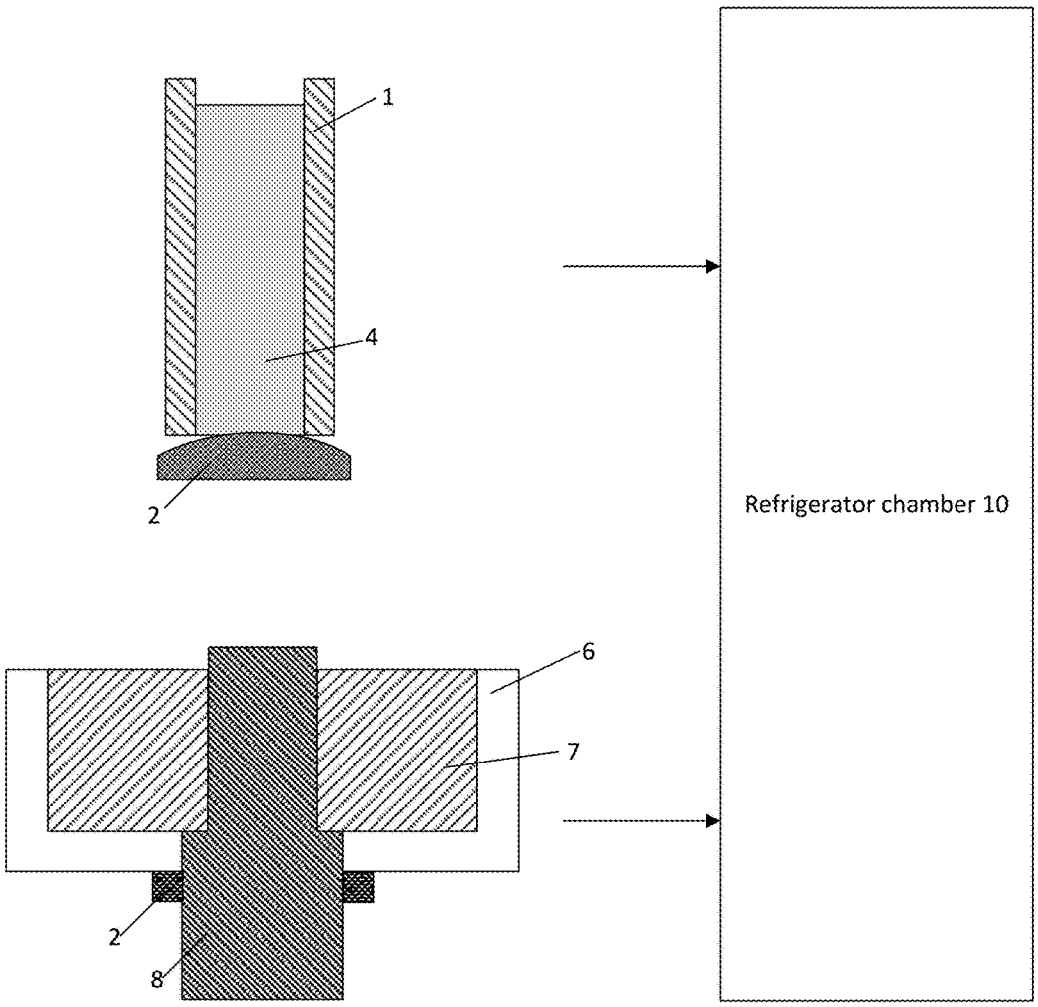
FIG. 8 illustrates a cutting tool to be placed into a refrigerator chamber.
Figure 9:
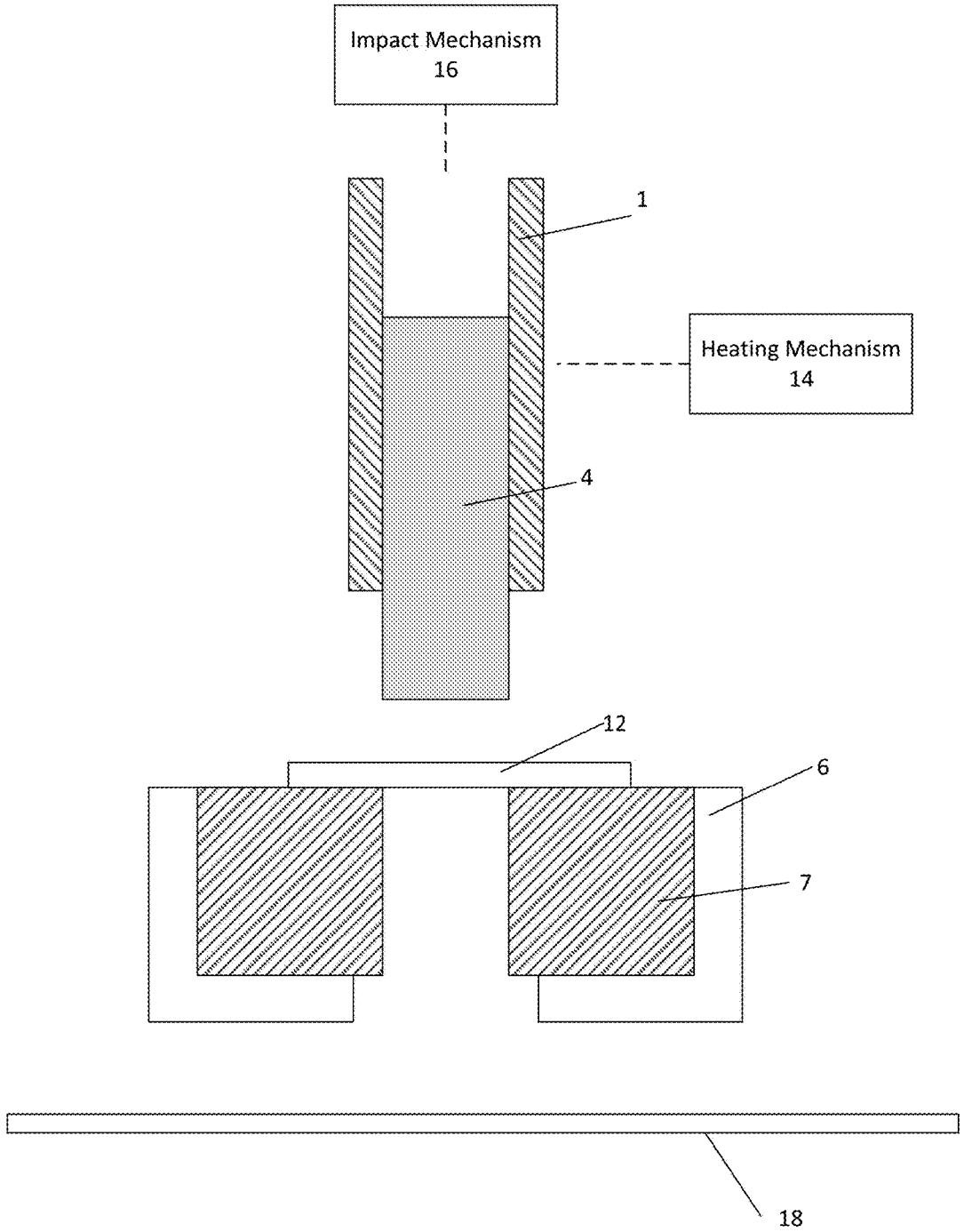
FIG. 9 illustrates a cutting tool where a molding container is positioned above a base container.
Figure 10:
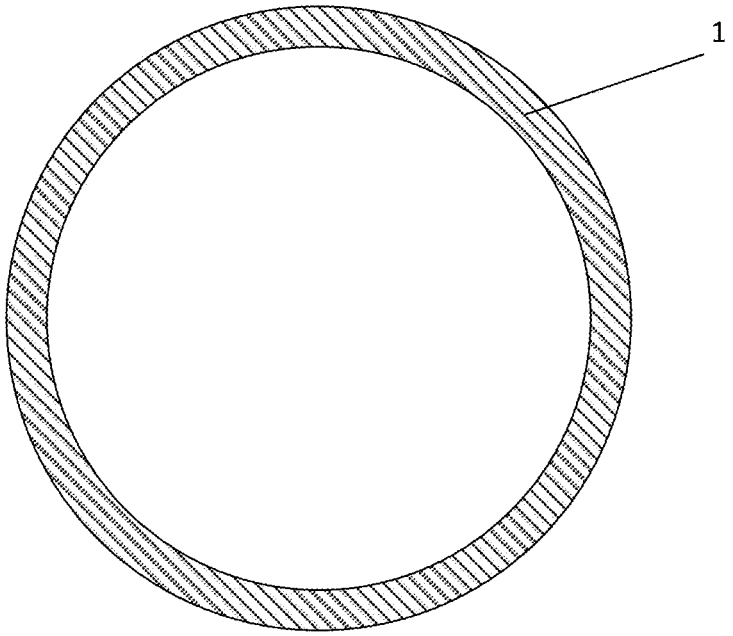
FIG. 10 illustrates a cross-sectional view of a molding container.

The technical solution adopted for the present invention is a low-cost, contamination-free cutting tool. As shown in FIG. 1 to FIG. 7, said cutting tool comprises a molding container (1), the molding container (1) contains a liquid (3) which can be frozen into a solid cutter (4), and a seal member (2) used to seal an opening of the molding container (1) is set on the molding container (1);

a liquid (3) to be frozen is poured into the molding container (1), the seal member (2) keeps the liquid (3) to be frozen contained in the molding container (1); after the molding container (1) together with the seal member (2) is put into a refrigerating chamber (10), the liquid (3) to be frozen is quick frozen to form a solid cutter (4), then the seal member (2) is removed, the cutter (4) and the molding container (1) are moved to the position of the object (12) to be cut, a heating mechanism (14) heats the exterior wall of the molding container (1) so that slight melting happens to the contact surface between the cutter (4) and the molding container (1) to form a melting surface (5), and an impact mechanism (16) is used to quickly impact the cutter (4) so that the cutter (4) moves quickly to perform cutting operations on the object (12) to be cut;

said cutting tool further comprises a base container (6), the base container (6) comprises a seal member (2) used to seal an opening of the base container (6) and a liquid (3) to be frozen in the base container (6); the liquid (3) to be frozen in said base container (6) is frozen into a frozen base (7), the object to be cut is attached to the frozen base (7), and the cutter (4) performs cutting operations on the object to be cut on the frozen base (7) so that the object to be cut will not contact other parts of the cutting tool.

The cutter (4) cooperates with the frozen base (7) to perform cutting operations. The cutter (4) and the frozen base (7) are both disposable, cutting operations can be guaranteed to be performed in a clean environment, no cross-contamination will be caused, and no washing is required for the cutting tool so that the convenience and efficiency of cutting operations are greatly improved. In addition, water serving as the liquid (3) to be frozen guarantees a low use cost.

The molding container (1) is a round cylinder. Openings are set at the top and bottom of the molding container 1, a seal member (2) is set at the bottom opening of the molding container (1), and the liquid (3) to be frozen is poured from the top opening of the molding container (1) into the molding container (1).

The base container (6) is a round cutting tool shaped column. A through-hole cooperating with the cutter (4) is set in the middle of the base container (6), and the cutter (4) enters the through-hole in the frozen base (7) after the cutter (4) cuts the object to be cut on the top of the frozen base (7). A cutting tool shaped column (8) is threaded through the middle of the base container (6). After freezing is completed, the cutting tool shaped column is drawn out and a through-hole cooperating with the cutter is formed in the middle of the frozen base (7).

The base container (6) and the molding container (1) are made of a metal and the heating mechanism is an eddy current heater. The eddy current heater can heat the metallic molding container (1) efficiently and quickly and can also make the base container (6) and the molding container (1) withstand the pressure caused by volume expansion after the liquid (3) to be frozen is frozen.

The impact mechanism is high-speed impact equipment and the impact equipment impacts the cutter (4). Not only a sterile working environment can be guaranteed, but also the working cost can be reduced. The liquid (3) to be frozen can be water. It is convenient and cheap to use water. Water can quick be frozen into ice to meet the requirements of cutting operations and the use cost is extremely low.

For the low-cost, contamination-free cutting tool in the present invention, the cutter and frozen base used for the cutting tool are formed by freezing a low-cost liquid and they are disposable so that cross-contamination caused by repeated use of a cutter to the samples and the object to be cut can be prevented; no cross-contamination will happen to the object to be cut during cutting operations, no washing is required for the cutter, the use cost is low, and the accuracy of sample test and the cleanness of the samples and the material to be cut can be guaranteed to the greatest extent; the cutting tool can be used to perform cutting operations on various materials and has excellent universality; when water is used as a liquid to be frozen, the cutting tool has the characteristics such as a low cost and no contamination, and can satisfy the requirements of various cutting operations, and it is easy to popularize the cutting tool. The cutting tool is freed from the harsh requirement for a wet application environment preventing electrostatic adherence.

Embodiment 2

As shown in FIG. 1 to FIG. 7, an operation method of the low-cost, contamination-free cutting tool comprises the following steps:

1) add a seal member (2) to the bottom openings of the molding container (1) and the base container (6) to seal the bottom openings, respectively;

2) pour the liquid to be frozen from the top openings of the molding container (1) and the base container (6) respectively until the volumes of the liquid (3) to be frozen are 6/10 to 14/15 of the volumes of the molding container (1) and the base container (6), respectively; the volume of the liquid to be frozen must be smaller than the volumes of the containers lest the solid the liquid (3) is frozen into will protrude from the molding container (1) and the base container (6) because of volume expansion;

3) move the molding container (1) and the base container (6) into which the liquid (3) to be frozen is poured into a refrigerating chamber to quickly freeze the liquid (3) into a solid state to form a cutter (4) and a frozen base (7);

4) remove the seal member (2) from the bottom openings of the molding container (1) and the base container (6), respectively, 5) move the base container (6) and the frozen base (7) in it to the cutting station (18) and put the object to be cut on the top of the frozen base (7);

6) move the molding container (1) and the cutter (4) in it to the cutting station and keep the cutter (4) right above the object to be cut and the lower end of the cutter (4) aligned with the through-hole in the frozen base (7);

7) use a heating mechanism to heat the side wall of the molding container (1) so that slight melting happens to the contact surface between the cutter (4) and the molding container (1) to help the impact mechanism to push out the cutter (4); and 8) use an impact mechanism to impact the cutter (4) to push out the cutter quickly so that the cutter performs cutting operations on the object to be cut and the cutter (4) and the material cut off together enter the through-hole in the frozen base (7) to complete cutting operations.

The cutter (4) and the frozen base (7) are both disposable and can be discarded after cutting is completed. Thus, convenience, cleanness, and no contamination can be guaranteed for cutting operations, without any necessity of washing the cutting tool. The cutting tool is used to perform cutting operations on solid objects such as paper, plastic, and biological samples. The cutting tool can perform cutting operations on various materials and has excellent universality.

For the operation method of the low-cost, contamination-free cutting tool in the present embodiment, the operation process is simple and efficient, and the cutting tool can perform cutting operations quickly so that the cutting tool can be applied in many fields to conveniently perform operations.

Finally, it should be pointed out that the embodiments above are obviously the examples given to clearly describe the present invention only, but are not used to limit the implementation modes of the present invention. Those skilled in the art can make variations or modifications in different forms on the basis of the description above. It is unnecessary and also impossible to enumerate all implementation modes of the present invention here. All variations or modifications obviously derived from the present invention should fall within the protection scope of the present invention.

The invention claimed is:

1. A cutting tool, comprising:

a molding container having a bottom opening;

a first material contained in the molding container, the first material having a liquid phase before refrigeration, the first material having a solid phase under refrigeration, the first material in the solid phase removable from the molding container through the bottom opening to perform a cutting operation on an object;

a first seal member to seal the bottom opening of the molding container to keep the first material in the molding container during refrigeration, wherein the first seal member is removable from the molding container after refrigeration;

a base container;

a second material contained in the based container, the second material having a liquid phase before refrigeration, the second material having a solid phase under refrigeration, wherein the second material in the solid phase supports the object upon which the cutting operation is performed;

a second seal member to seal an opening of the base container to keep the second material in the base container during refrigeration; and a removable column positioned in a middle of the base container and surrounded by the second material in the liquid phase during refrigeration with the second seal member sealing the opening of the base container to keep the second material in the base container, wherein the column is removable from the base container and separable from the second material after refrigeration resulting in a through hole formed through the second material in the solid phase, the column is of a size such that the resulting through hole accommodates the first material to traverse therethrough after the first material exits the molding container.

2. The cutting tool according to claim 1, wherein the molding container has a configuration of a column, wherein a cross-section of the molding container is an enclosed shape, wherein the molding container has a top opening and a bottom opening, wherein the seal member is set at the bottom opening of the molding container, wherein the top opening of the molding container is configured to receive the first material in the liquid phase poured into the molding container.

3. The cutting tool according to claim 1, wherein the base container and the molding container are made of a metal.

4. The cutting tool according to claim 1, wherein the first liquid is water.

5. The cutting tool according to claim 1, wherein the removable column has a cross-section dimension at least as large as a cross-section dimension of the first material in the solid phase.

6. An operation method of a cutting tool, comprises:

(1) add a first seal member to a bottom opening of a molding container, and add a second seal member to a base container to seal its bottom opening, (2) pour a first liquid to be frozen from a top opening of the molding container until the first liquid reaches 6/10 to 14/15 volume of the molding container, pour a second liquid to be frozen from a top opening of the base container until the second liquid reaches 6/10 to 14/15 volume of the base container, (3) move the molding container containing the first liquid into a refrigerator chamber to freeze the first liquid into a solid state to form a cutter, and move the base container containing the second liquid into a refrigerator chamber to freeze the second liquid into a solid state to form a frozen base, (4) remove the first seal member from the bottom opening of the molding container, and remove the second seal member from the bottom opening of the base container, (5) move the base container and the frozen base therein to a cutting station and put an object to be cut on top of the frozen base, (6) move the molding container and the cutter therein to the cutting station, keep the cutter right above the object to be cut, and keep a lower end of the cutter aligned with a through-hole in the frozen base, (7) use a heating mechanism to heat a side wall of the molding container so that a contact surface between the cutter and the molding container melts, and (8) use an impact mechanism to impact the cutter to push out the cutter so that the cutter performs a cutting operation on the object to be cut, and the cutter and the material cut off together enter the through-hole in the frozen base to complete the cutting operation.

7. The operation method of a cutting tool according to claim 6, wherein the cutter and the frozen base are both disposable and can be discarded after cutting is completed.

* * * * *